US005294901A

United States Patent [19]

Tacinelli et al.

[11] Patent Number: 5,294,901

[45] Date of Patent: Mar. 15, 1994

[54] MOLDED CASE CIRCUIT BREAKER INSULATED ARMATURE LATCH ARRANGEMENT

[75] Inventors: Mario A. Tacinelli, Plainville; Joseph M. Palmieri, Southington; Joseph B. Kelaita, Jr., Bristol, all of Conn.; Eva E. Matias, Mayaguez, P.R.

[73] Assignee: General Electric Company, New York, N.Y.

[21] Appl. No.: 72,023

[22] Filed: Jun. 7, 1993

Related U.S. Application Data

[63] Continuation-in-part of Ser. No. 940,944, Oct. 28, 1992.

[51] Int. Cl.[5] ..... H01H 75/12

[52] U.S. Cl. ..... 335/35; 335/23

[58] Field of Search ..... 335/23, 24, 25, 35, 335/36, 37, 38, 39, 40, 41, 42

[56] References Cited

U.S. PATENT DOCUMENTS

| | | | |
|---|---|---|---|
| 2,844,689 | 7/1958 | Middendorf | 200/116 |
| 3,162,739 | 12/1964 | Klein et al. | 335/35 |
| 3,246,098 | 4/1966 | Hall | 200/88 |
| 3,288,965 | 11/1966 | Klein | 200/116 |
| 3,421,123 | 1/1969 | Johnson et al. | 335/35 |
| 3,467,920 | 9/1969 | Hall et al. | 335/23 |
| 4,481,491 | 11/1984 | Heft et al. | 335/21 |
| 4,725,800 | 2/1988 | Grunert et al. | 335/38 |

*Primary Examiner*—Lincoln Donovan

*Attorney, Agent, or Firm*—Richard A. Menelly

[57] ABSTRACT

An electric circuit breaker operating mechanism includes an insulated armature latch which prevents deleterious arc formation between the operating mechanism cradle and the armature latch surface when the circuit breaker contacts are separated under overcurrent circuit conditions. The insulated armature latch carries a tolerance take-up spring which interacts between the operating mechanism cradle and the circuit breaker trip bar assembly to insure free travel of the operating cradle during contact separation.

9 Claims, 3 Drawing Sheets

9

MOLDED CASE CIRCUIT BREAKER INSULATED ARMATURE LATCH ARRANGEMENT

This application is a continuation in part of Ser. No. 940,944, filed on Oct. 28, 1992.

BACKGROUND OF THE INVENTION

U.S. Pat. No. 3,288,965 describes a residential type circuit breaker assembly containing a movable contact assembly, an operating spring, a releasable member called a cradle and a latch member. The metallic cradle tip is held by the metallic latch member until the latch is moved from under the cradle by conventional thermal or magnetic means to release the cradle and trip the breaker. The operating spring directly connects the movable contact assembly to the metallic cradle and its tip rests directly upon the metallic latch. There is no intentional connection of the latch to the load terminal and hence no intentional current flow through the cradle to the latch engaging surface.

When the breaker is subjected to short circuit currents, the contacts are separated by magnetic forces before the latch can be disengaged from the cradle by the conventional thermal tripping means. An unintentional circuit between the cradle and the latch roughens the engaging surfaces and greatly increases the force required to trip the breaker during subsequent operations. One possible explanation being that the cradle is electrically connected to the movable contact arm by the operating spring. An insulator such as that described within U.S. Pat. No. 2,844,689 is used within some circuit breaker designs to deter a conduction path from the movable contact arm directly to the latching tip of the cradle and to the engaging surface of the latch.

U.S. Pat. No. 4,481,491 describes an insulated latching arrangement in the form of an apertured fiber insulating plate that receives the end of the cradle without allowing electrical contact between the end of the cradle and the latch. It has been determined, however, that long term movement of the metallic cradle tip over the surface of the fiber insulating plate could cause slight erosion of the fiber material. The latching arrangement also includes a tolerance take-up spring that interacts with the circuit breaker trip bar and the circuit breaker cradle to ensure that the cradle tip is at its lowest possible position after responding to an overcurrent trip function.

U.S. Pat. Nos. 3,246,098 and 3,467,920 both describe a z-shaped latch plate within the latch assembly arranged for supporting the cradle tip during quiescent circuit current conditions.

Applicants have determined that a common metal insert attached within the latch assembly, by means of an insulative plate, will allow the cradle tip to interact with the metal insert surface at one end while multifunctionally providing tolerance take-up function at an opposite end.

Accordingly, one purpose of the invention is to provide an insulated armature latch assembly with metal-to-metal contact between the cradle tip and the latching surface, while providing tolerance take-up function without requiring an additional tolerance take-up spring.

SUMMARY OF THE INVENTION

An insulated armature latch and cradle assembly for electric circuit breakers prevents the occurrence of an electric circuit between the cradle tip and the armature latch surface. The armature latch multi-functionally employs a tolerance take-up spring to limit the operating cradle travel while the opposite end serves as the cradle tip latching surface. Long term contact between the cradle tip and the latching surface is accomplished with virtually no latching surface erosion.

DESCRIPTION OF THE PREFERRED EMBODIMENT

Figure 1:
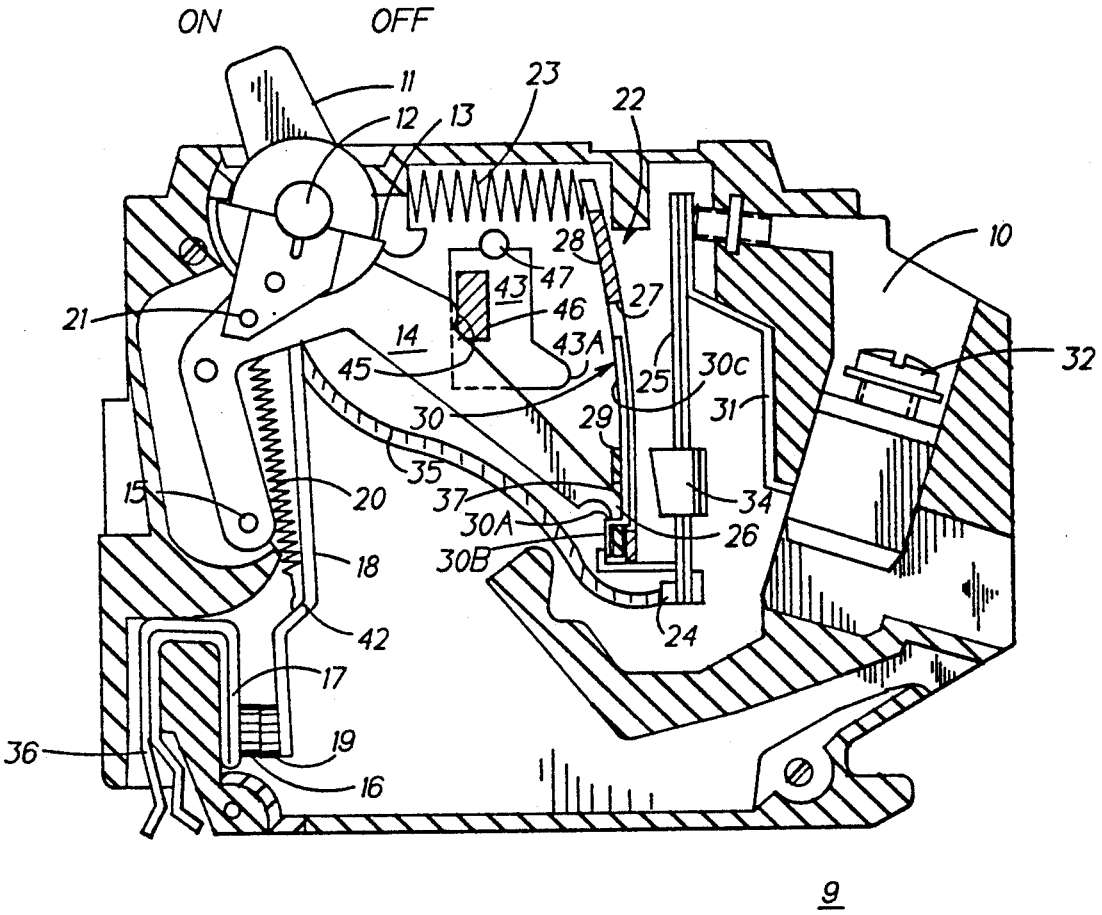
FIG. 1 is a side view of a molded case circuit breaker with the cover removed to depict the circuit breaker operating components with the circuit breaker in an "ON" condition.

FIG. 1 contains an electric circuit breaker 9 similar to the type described in aforementioned U.S. Pat. No. 4,481,491 which patent contains a complete description of the operation of a circuit breaker adaptable for common tripping assembly. The breaker consists of a plastic molded body 10 which supports an on-off handle 11 pivotably mounted to the body by means of a hub 12. A pair of spaced depending extensions 13 on handle 11 straddle a releasable member, or cradle, 14 which is pivotally supported in the body by means of pivot 15. A stationary contact 16 is connected to the load terminal 36 by means of a tang 17. A movable contact arm 18 carries a movable contact 19 for moving in and out of contact relation with the fixed contact by means of an over-center operating spring 20, which is attached to the movable contact arm at one end and is inserted within a hole 21 within cradle 14 at an opposite end. An armature latch assembly 22 is movably supported within the circuit breaker body 10 at one end by means of a compression spring 23. An extension 24 at the bottom end of a bimetal 25 interacts with the bottom of the armature latch during a thermal tripping operation. The integrated armature latch 22 includes a plate 28 of magnetic steel including a rectangular aperture 27 to which a plate 29 of insulating fiber material including a smaller rectangular aperture 37 is attached by rivets (not shown). A planar tolerance take-up spring 30 is attached to the fiber plate by a separate rivet (not shown). The tolerance take-up spring 30 multi-functionally provides a latching surface 30A for supporting the cradle tip 26 when the offset end 30B is inserted through the aperture 37 and the surface 30A sits on the bottom of the aperture. The linear end 30C of the tolerance take-up spring is positioned ahead of the end 43A of the trip bar carrier 43. The trip bar 46 attached to the trip bar carrier is positioned immediately ahead of the protrusion 45 provided on the front surface of the cradle 14. The interaction between the cradle, trip bar carrier and the tolerance take-up spring 30 will be described below in greater detail. Electrical connection is made with the bimetal 25 by means of one end of a line terminal strap 31, which receives the load terminal screw 32. A magnetic field piece 34 consisting of a generally U-shaped metallic member at least partially encompassing the bimetal assists in tripping the breaker under short circuit conditions. Electrical connection between the bimetal 25 and the movable contact arm 18 is made by means of a flexible conductor 35. With the handle in the "ON" condition, indicated in FIG. 1, electrical connection is made between the stationary contact 16 and the load terminal screw 32 by means of the path provided through the movable contact 19, movable contact arm 18, flexible conductor 35, bimetal 25 and terminal strap 31. Both the circuit breaker operating handle and the formed extensions 13 are made of an electrically insulating material so that the cradle 14 only contacts an electrically conducting metal component at two points. One point being the junction of spring 20 at hole 21 and the other point being the cradle tip 26 and the latching surface 30A when the breaker is in the untripped position. When the contacts are closed, the main current carrying path proceeds through the contacts 16, 19, movable contact arm 18 and the flexible connector 35 as indicated earlier. No current can flow through the contacts 16, 19, movable contact arm 18 and spring 20 which is connected to the movable contact arm as indicated at 42. This is because the cradle 14 which connects with both the spring 20 and armature latch 22 is insulated from the main current path by means of fiber plate 29.

As described in the aforementioned U.S. Pat. No. 4,481,491, an electrical path is prevented between the armature latch unit 22 and the cradle 14 and between the contacts 16, 19 upon circuit interruption under overload conditions. The insulative properties of the fiber plate 29 deters electrical transfer between the cradle and the armature latch, although the continuous friction generated between the cradle tip and the fiber material could cause the fiber material to become slightly eroded under extreme conditions in the manner described earlier.

Figure 2:
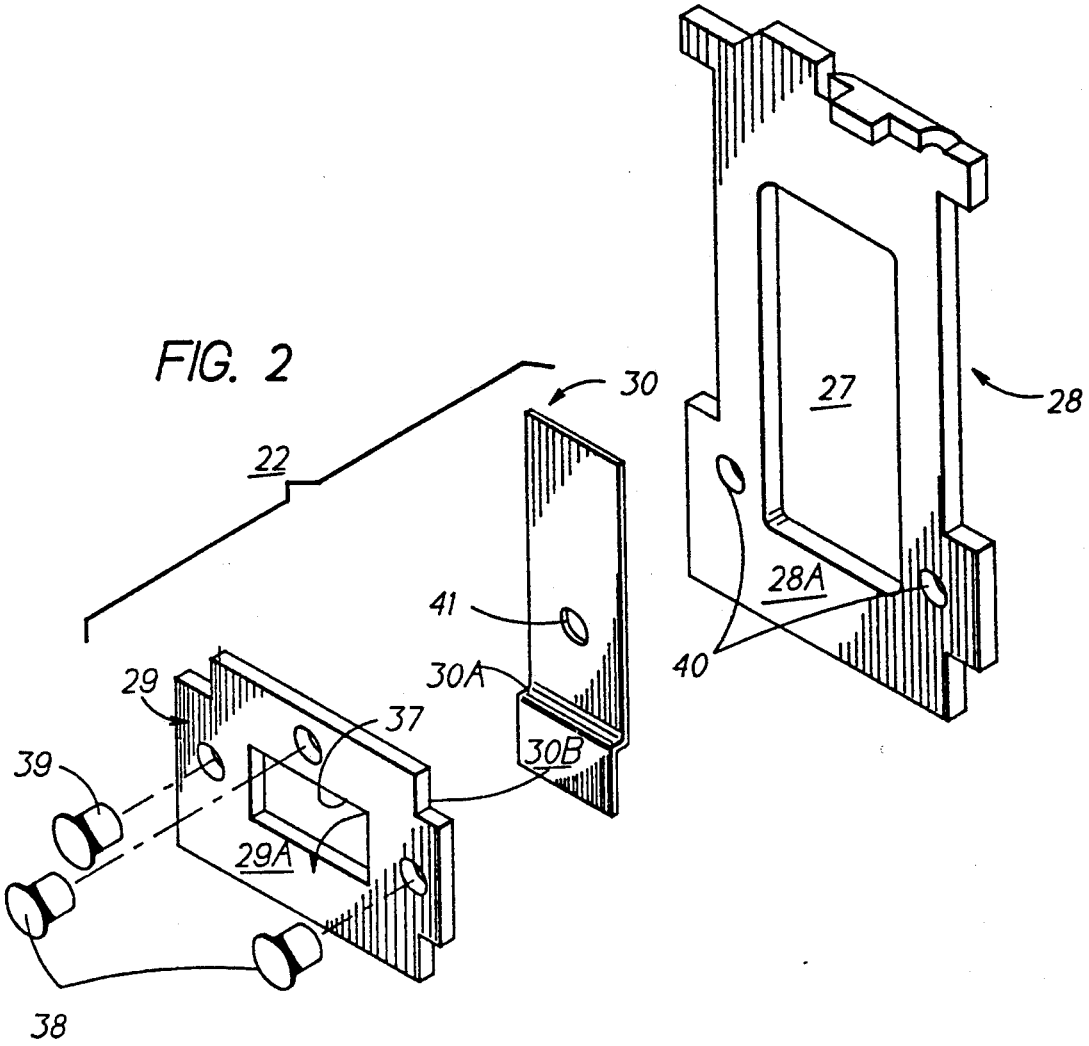
FIG. 2 is a top perspective view of the insulated latch arrangement of the invention prior to assembly.

The assembly of the components of the armature latch 22 is best seen by referring now to FIG. 2 wherein the steel plate 28 is arranged for receiving the fiber plate 29. Prior to attaching the tolerance take-up spring 30 to the metal plate, the offset end 30B at the end of the spring is inserted within the rectangular opening 37 in the fiber plate and the fiber plate is attached to the tolerance take-up spring by means of a rivet 39 and an associated thru-hole 41. The tolerance take-up spring 30 is next positioned within the opening 27 in the steel plate. The fiber plate with the tolerance take-up spring attached is next fastened to the steel plate by means of rivets 38 and associated thru-holes 40 such that the bottom part 29A of the fiber plate is trapped between the offset end 30B of the tolerance take-up spring 30 and the bottom part 28A of the steel plate. The fiber plate accordingly electrically insulates the tolerance take-up spring from the steel plate while at the same time attaching the tolerance take-up spring to the steel plate, as indicated.

Figure 3:
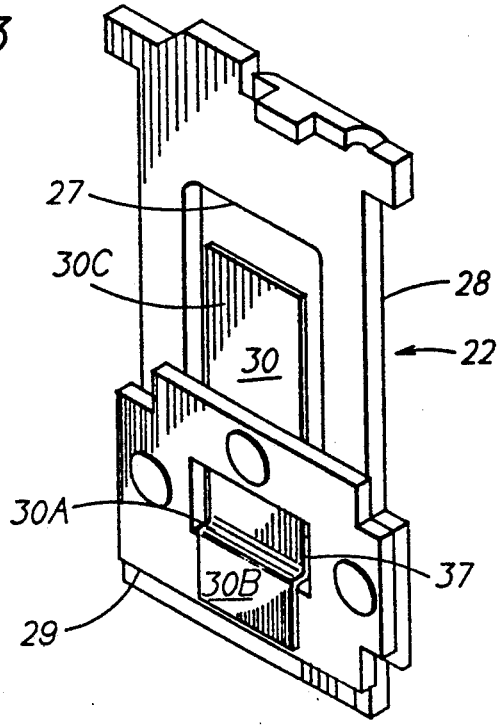
FIG. 3 is a front perspective view of the integrated latch of FIG. 2 after assembly.

The arrangement of the flat latching surface 30A of the tolerance take-up spring 30 within the bottom of the rectangular opening 37 in the fiber plate 29 is best seen by now referring to the armature latch 22 depicted in FIG. 3. The linear end 30C of the tolerance take-up spring 30 extends up within the opening 27 in the steel plate 28 while the offset end 30B of the spring extends downward against the surface of the fiber plate 29 for providing additional support to the spring when the cradle tip 26 (FIG. 1) is supported on the latching surface 30A.

Figure 4:
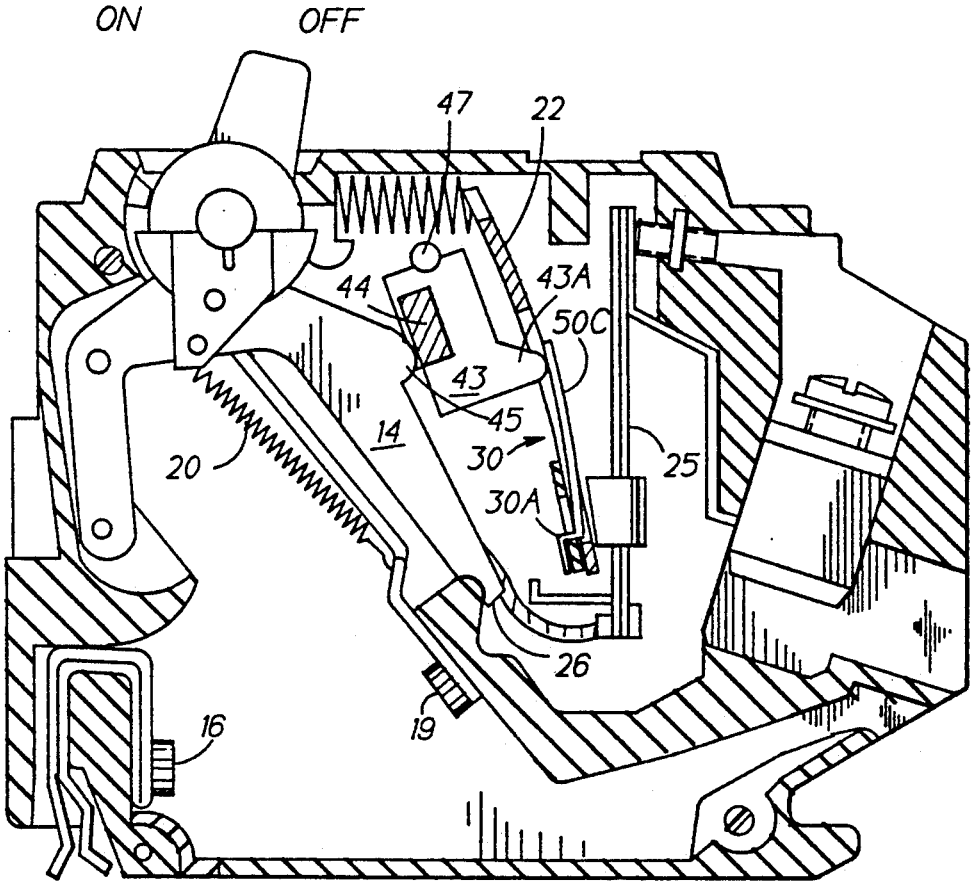
FIG. 4 is a side view of the circuit breaker of FIG. 1 with the circuit breaker in a "tripped" condition.

Upon occurrence of an overload condition, the bimetal 25 draws the armature latch assembly 22 away from the cradle as best seen by referring to the circuit breaker 9 depicted in FIG. 4. The cradle tip 26 is released from the latching surface 30A allowing the operating spring 20 to rapidly drive the movable contact 19 away from the fixed contact 16 to interrupt the associated electrical circuit. At the same time, the protrusion 45 at the knee of the cradle 14 contacts the trip bar carrier 43, rotating the contact carrier and associated trip bar 44 about the pivot 47 in the counterclockwise direction. The end 43A of the contact carrier strikes the linear end 30C of the tolerance take-up spring 30 deflecting the spring, as indicated, and thereby assuring that the cradle tip 26 will fall to its lowest position, as indicated. The provision of the tolerance take-up spring 30 accordingly allows for variations in the tolerances between the operating cradle, the trip bar carrier 43, and the armature-latch assembly 22 to ensure that the cradle does not jam against either the trip bar carrier or the armature-latch assembly.

A circuit breaker having excellent long term operating performance has herein been described whereby a multi-functional armature latch deters the transfer of current between the cradle tip and the latching surface as well as between the armature latch and the tolerance take-up spring during intense overcurrent operating conditions.

Having thus described our invention, what we claim as new and desire to secure by Letters patent is:

1. A molded case circuit breaker having an integrated armature latch assembly comprising:
   - a molded plastic case attached to a molded plastic cover;
   - an operating mechanism arranged within said case for interrupting current through a protected circuit upon the occurrence of an overcurrent condition;
   - a pivotally-mounted operating cradle interacting with said operating mechanism by means of a shaped end; and
   - a magnetically-responsive armature latch comprising a metal plate including a first rectangular opening, an insulative plate including a second rectangular opening fastened to said metal plate and a tolerance take-up spring having a top part within said first rectangular opening interacting with a trip bar carrier and a bottom part within said second rectangular opening supporting said shaped end of said operating cradle.

2. The circuit breaker of claim 1 wherein said shaped end of said operating cradle is retained on said bottom part under quiescent circuit current conditions to deter said operating mechanism from interrupting said circuit current and wherein said shaped end is released from said bottom part during an overcurrent condition.

3. The circuit breaker of claim 1 wherein said bottom part comprises an offset end positioned on a bottom part of said second opening.

4. The circuit breaker of claim 1 wherein said metal plate is electrically-isolated from said tolerance take-up spring.

5. The circuit breaker of claim 1 wherein said insulative plate comprises a fiber.

6. The circuit breaker of claim 1 wherein said metal plate is fastened to said insulative plate.

7. The circuit breaker of claim 1 wherein said tolerance take-up spring is fastened to said insulative plate.

8. The circuit breaker of claim 1 wherein a first part of said operating cradle strikes against the trip bar carrier during an overcurrent condition.

9. The circuit breaker of claim 1 wherein a second part of the trip bar carrier contacts said top part of said tolerance take-up spring during said circuit interruption to deflect said top part and provide tolerance take-up between said trip bar carrier, said latch and said operating cradle.

* * * * *

UNITED STATES PATENT AND TRADEMARK OFFICE

CERTIFICATE OF CORRECTION

PATENT NO. : 5,294,901
DATED : March 15, 1994
INVENTOR(S) : Mario A. Tacinelli, et. al.

It is certified that error appears in the above-indentified patent and that said Letters Patent is hereby corrected as shown below:

Title page, item [63], under Related U.S. Application Data --Continuation-in-part of Ser. No. 949,944, Sept. 24, 1992--.

Signed and Sealed this

Nineteenth Day of July, 1994

*Attest:*

*Attesting Officer*

BRUCE LEHMAN

*Commissioner of Patents and Trademarks*